US005470077A

United States Patent [19]

Brewster et al.

[11] Patent Number: 5,470,077

[45] Date of Patent: Nov. 28, 1995

[54] GOLF BOARD GAME APPARATUS

[75] Inventors: Wilfred G. Brewster, Mount Helena; Michael D. Forrester, Greenmount, both of Australia

[73] Assignee: Golf Games International (Australia) Pty Ltd., West Perth, Australia

[21] Appl. No.: 684,906

[22] PCT Filed: Oct. 26, 1989

[86] PCT No.: PCT/AU89/00463

§ 371 Date: Oct. 28, 1991

§ 102(e) Date: Oct. 28, 1991

[87] PCT Pub. No.: WO90/00443

PCT Pub. Date: May 3, 1990

[30] Foreign Application Priority Data

Oct. 26, 1988 [AU] Australia ..... PJ1155

[51] Int. Cl.[6] ..... A63F 3/00

[52] U.S. Cl. ..... 273/245

[58] Field of Search ..... 273/243, 244, 273/245, 248, 249, 277

[56] References Cited

U.S. PATENT DOCUMENTS

| | | | |
|---|---|---|---|
| 2,157,172 | 5/1939 | Hays | 273/245 |
| 3,612,534 | 10/1971 | Browne . | |
| 3,771,792 | 11/1973 | Crumlish . | |
| 3,944,229 | 3/1976 | Feeney | 273/245 |
| 4,134,590 | 1/1979 | Conrad | 273/245 |
| 4,380,338 | 4/1983 | Lacy | 273/245 |
| 5,000,460 | 3/1991 | Barbiaux et al. | 273/245 |

FOREIGN PATENT DOCUMENTS

| | | | |
|---|---|---|---|
| 1556032 | 11/1979 | United Kingdom | 273/245 |
| 2220147 | 1/1990 | United Kingdom | 273/245 |

*Primary Examiner*—William E. Stoll

*Attorney, Agent, or Firm*—Reising, Ethington, Barnard, Perry & Milton

[57] ABSTRACT

A golf board game comprises a game board (10) marked out into a plurality of golf holes (12). Each of the golf holes (12) comprises a tee area (14), a fairway area (16), an obstruction area (20) and a golf green area (18) having a pin and a plurality of distinct place markers (T1 to T6, FA1 to FA5, FB1 to F5, BB1 to BB5) on or about each golf hole (12). A bank of devices (66) comprising five discs (68) fortuitously determines the result of the tee stroke. Each golf hole (12) has at least a first card (76) having an indication of the place marker (T1 to T6) to which a golf ball travels as a result of the tee stroke. The first card (76) also has an indication as to the nature of the subsequent stroke or strokes to be played, and one or more further cards (76) correspond to the nature of the next stroke to be played. The devices (66) fortuitously determine the results of the or each subsequent stroke.

13 Claims, 16 Drawing Sheets

Side 1. Holes 1–9.

Side 1. Holes 1–9.

75

SCORE CARD

PLEASE OBSERVE RULES & ETIQUETTE (See over)

GOLF WORLD COUNTRY CLUB

EVENT _____

PLAYER _____

PARTNER _____

DATE _____

HANDICAP _____

HANDICAP _____

| RESULT |
|---|
| Gross |
| Nett |

| Holes | Yards | Meters | Stroke Index | Par | Player | Partner | WIN + HALF 0 LOSS - | Marker | Partner | WIN + HALF 0 LOSS - |
|---|---|---|---|---|---|---|---|---|---|---|
| 1 | 328 | 300 | 12 | 4 | | | | | | |
| 2 | 394 | 360 | 3 | 4 | | | | | | |
| 3 | 204 | 187 | 13 | 3 | | | | | | |
| 4 | 519 | 475 | 7 | 5 | | | | | | |
| 5 | 350 | 320 | 9 | 4 | | | | | | |
| 6 | 470 | 430 | 11 | 5 | | | | | | |
| 7 | 218 | 199 | 8 | 3 | | | | | | |
| 8 | 438 | 401 | 2 | 4 | | | | | | |
| 9 | 316 | 289 | 17 | 4 | | | | | | |
| Out | 3237 | | | 36 | | | | | | |

| Holes | Yards | Meters | Stroke Index | Par | Player | Partner | WIN + HALF 0 LOSS - | Marker | Partner | WIN + HALF 0 LOSS - |
|---|---|---|---|---|---|---|---|---|---|---|
| 10 | 498 | 456 | 11 | 5 | | | | | | |
| 11 | 317 | 290 | 16 | 4 | | | | | | |
| 12 | 241 | 220 | 6 | 3 | | | | | | |
| 13 | 337 | 308 | 15 | 4 | | | | | | |
| 14 | 344 | 315 | 14 | 4 | | | | | | |
| 15 | 366 | 335 | 4 | 4 | | | | | | |
| 16 | 185 | 169 | 18 | 3 | | | | | | |
| 17 | 547 | 500 | 5 | 5 | | | | | | |
| 18 | 441 | 403 | 1 | 4 | | | | | | |
| In | 3276 | 2995 | | 36 | | | | | | |
| Out | 3237 | 2961 | | 36 | | | | | | |
| Total | 6513 | 5957 | | 72 | | | | | | |

Marker's Signature _____

Player's Signature _____

THE GOLF GAME FOR ALL THE FAMILY

Fig. 4

HOLE NO. 4
INDIA

475m Par 5

① Too worried about the hazard ahead, you decelerate during your down swing and the ball lands in the canyon. Add 2 shots for "out of bounds" and respin, except number 1. Always take a low, slow backswing through the ball.

② Negative thoughts cause you to slice the ball into the right hand rough, over the canyon. When driving off the tee, try to aim for a target in the distance. Concentrate on making a good sho t, not on the trouble that lies ahead. Fairway Card 2(a) next.

③ Swinging the club back too straight behind the ball causes you to pull your drive over the canyon to the left side of the fairway. Next shot Fairway Card 2(a).

④ Nice slow swing results in an accurate drive 220m to the right-hand side of the fairway. Play Fairway Card 2(a) now.

⑤ A positive, full flowing swing produces a massive drive to the centre of the fairway 250 metres. Rhythm and timing with good body rotation gives length without strength. Fairway Card 2(a) next shot.

TEE

CARD 1

76

Fig. 6a

HOLE NO. 4
INDIA

475m Par 5

(1) Coins are jingled by a fellow player as you are about to hit, the distraction causes you to slice your fairway wood to the right and near the creek. Next time, stop your swing if your concentration is disturbed. Try a pitch next turn.

(2) A hooked fairway wood rolls to the left hand rough and into a cobra's hole. You play another ball within two club lengths of this hole, without penalty. Use your legs more during the next swing to help prevent a hooked shot. Next shot is a pitch.

(3) Swinging smoothly you play a nice wood shot to the right-hand fairway. Rhythm, timing and full rotation of the body have combined to give a long well-flighted shot. Pitch next spin.

(4) You make a good swing and the ball flies straight down the fairway centre. Nice shot. Play a pitch next.

(5) You do everything right during the swing and the result is a mighty fairway wood to the front centre of the green. Play a long putt next.

FAIRWAY

CARD 2(a)

76

Fig.6b

HOLE NO. 4
INDIA

475m Par 5

(1) An insufficient hip and shoulder turn on the back swing causes a lack of power and leaves the ball short at the front of the putting green. Play your long putt next.

(2) You underestimate the strength of the wind and the ball drifts left into the bunker. Sometimes when the wind is gusty it is not easy to allow for. Remember, scores will always be higher in the wind because the course is more difficult then.

(3) You sway your body during the swing, and the ball flies into the right hand bunker. If you lose your balance during the downswing you probably have swung too hard at the ball.

(4) A nicely struck iron shot finishes at the rear of the green. Play your long putt next.

(5) Well done! Correct club selection and a good swing lands the ball on the green next to the flag stick. Have a short putt next.

FAIRWAY

CARD 2 (b) —76

Fig.6c

HOLE NO. 4
INDIA

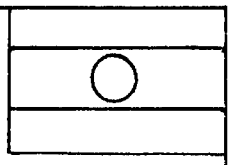

475m Par 5

1. Wet sand after the tropical rain makes the ball skid out of the bunker and onto the back edge of the green. Next time use your pitching wedge, not the sand wedge, if the bunker is wet. Have a long putt now.
2. What a terrible swing - you lift your head and shoulders up as you hit your shot and half top the ball. It hits the lip of the bunker and rolls back in. Count 1 shot and respin, except number 2.
3. An excellent explosion shot lands the ball 3 metres past the hole with tremendous backspin, it jumps backwards and finishes beside the hole. Fantastic! Play your short putt next.
4. You visualise the ball going into the hole and play just the shot you want. It's in. Beauty!
5. You look up too quickly and skull your shot over the green. Luckily it hits the clubhouse wall and bounces back onto the edge of the green. It's a long putt next.

PITCHING AND BUNKER

CARD 3

76

Fig.6d

HOLE NO. 4
INDIA

475m Par 5

① Good putt but the ball runs around the lip of the cup and does not drop in. Concentrate on your short putt next, and try to forget about the near miss.

② Your long stroke with the putter rolls the ball well past the hole. More practice at putting will help you get the "feel" for distance. Have another long putt.

③ Nicely putted and the ball pulls up close to the pin. Keep the smooth back-and- through action for all your short putts.

④ The greens are heavy after the monsoon rains causing your putt to stop well short. It's still a long putt. Respin except number 4. When the putting surface is wet, make a longer backswing to allow for the slower pace of the green.

⑤ You imagine the ball rolling into the hole and promptly putt it in. It's amazing how a positive mental attitude will help lead to a good shot.

LONG PUTTING

CARD 4

76

Fig.6e

HOLE NO. 4
INDIA

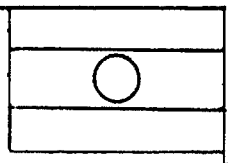

475m Par 5

1. Your attempt to putt the ball into the hole is unsuccessful, and the ball stops on the edge of the hole. You tap the next one in. Score 2.
2. A player drops his putter during your stroke and it distracts you. You pull your putt to the left of the hole. The next putt is better, so you are in for 2.
3. The ball is hit too hard but luckily it hits the back of the hole, jumps up and drops in.
4. You block your putt and push the ball right of the hole, then you tap in for 2. Keep your wrists firm during any putt by making the stroke with the arms and shoulders.
5. A stable body and a well-stroked putt rolls the ball into the hole. It is important not to move your legs during a putt. Some good players lock their knees inwards to prevent any lower body movement during the putting stroke.

SHORT PUTTING

CARD 5

76

Fig.6f

GOLF GAMBLE CARD

YOU ACCIDENTALLY DROP THE FLAGSTICK ON THE GREEN CAUSING SOME DAMAGE UNDER THE GAME ETIQUETTE RULES YOU MUST PAY THE OTHER PLAYERS $1,000. RESPIN.

78

Fig.7a

GOLF GAMBLE CARD

YOU ARE VERY, VERY CARELESS! YOU HAVE PLAYED THE WRONG BALL! TAKE A 2 SHOT PENALTY AND SPIN AGAIN.

78

Fig.7b

GOLF GAMBLE CARD

DAWDLING ON THE COURSE DOESN'T PAY - YOU RECEIVE A 2 SHOT PENALTY. MAKE SURE YOU KEEP UP WITH THE PLAYERS IN FRONT OF YOU, NEVER BE MORE THAN ONE FAIRWAY BEHIND THEM. RESPIN ANY NUMBER OTHER THAN YOUR LAST SPIN.

78

Fig.7c

GOLF GAMBLE CARD

YOU PLAYED OUT OF TURN. THE COURSE RULES FOR THIS TOURNAMENT SAY THAT YOU MUST PAY A FINE OF $1,000 TO EACH PLAYER, SPIN AGAIN EXCEPT YOUR PREVIOUS NUMBER.

78

Fig.7d

GOLF BOARD GAME APPARATUS

The present invention relate to a golf board game apparatus.

The golf board game apparatus allows users to simulate golf without the need for a conventional golf course. In the context of the present invention, terms used are generally equivalent to those used in relation to a conventional golf course upon which conventional games of golf are played.

SUMMARY OF THE INVENTION

In accordance with one aspect of the invention there is provided a golf board game apparatus characterised by a game board marked out into a plurality of golf holes, each of the golf holes comprising a tee area, a fairway area, an obstruction area and a golf green area having a pin, a plurality of distinct place markers on or about each golf hole, means for fortuitously determining the result of a tee stroke, each golf hole having a first card means having an indication of the place marker to which a golf ball travels as a result of the tee stroke, the first card means also having an indication as to the nature of the next stroke to be played, and one or more further card means corresponding to the nature of the subsequent stroke or strokes to be played, and means for fortuitously determining the result of the or each subsequent stroke.

BRIEF DESCRIPTION OF THE DRAWINGS

The present invention will now be described, by way of example, with reference to the accompanying drawings, in which:

FIG. 4 is a plan view of a golf score card for use with the golf board game of the present invention;

Figure 8:
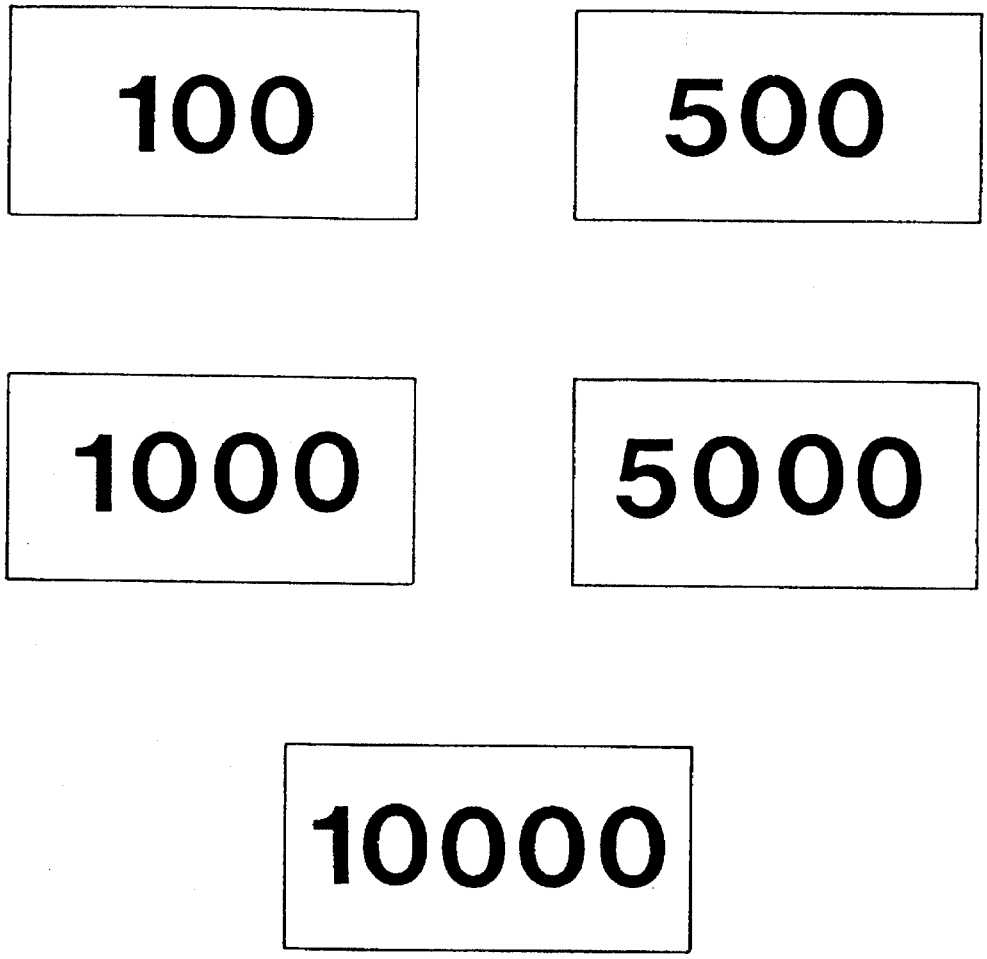

FIGS. *6a*, *6b*, *6c*, *6d*, *6e* and *6f* are plan views of a representative sample of hole cards;

FIGS. *7a*, *7b*, *7c*, and *7d* are plan views of a representative sample of golf gamble cards;

FIG. 8 is a plan view of play money; and

Figure 9:
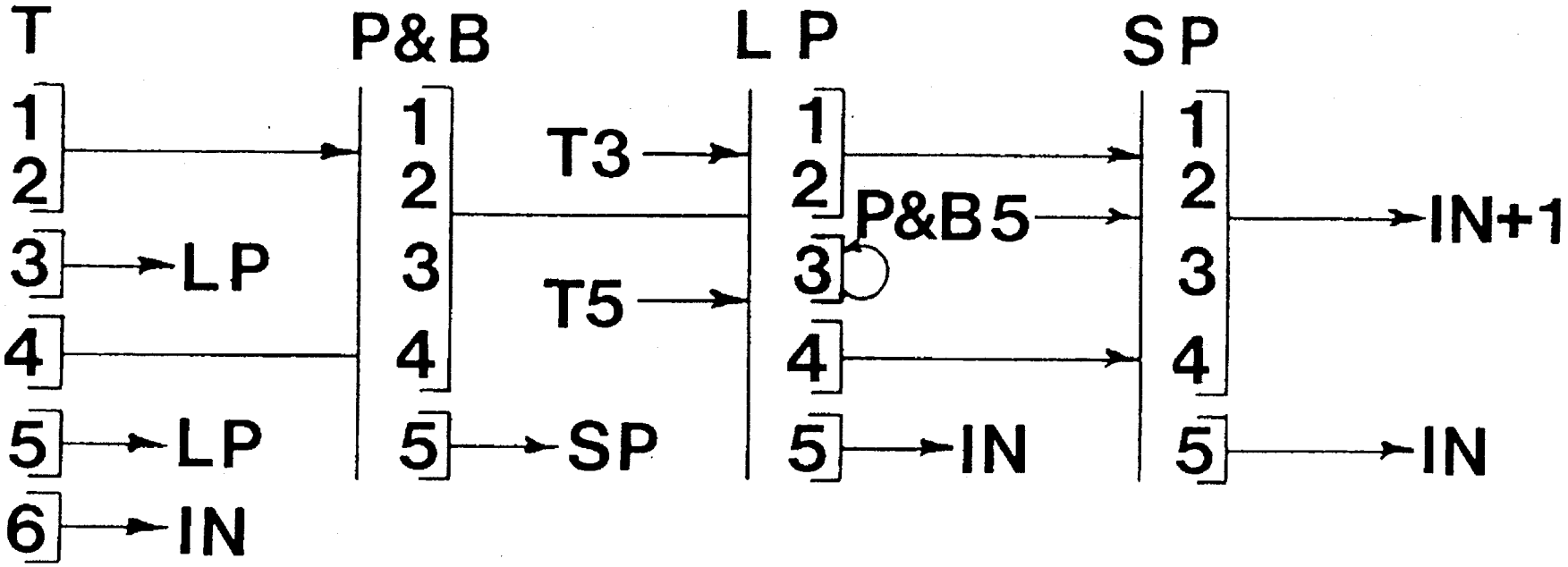
Figure 10:
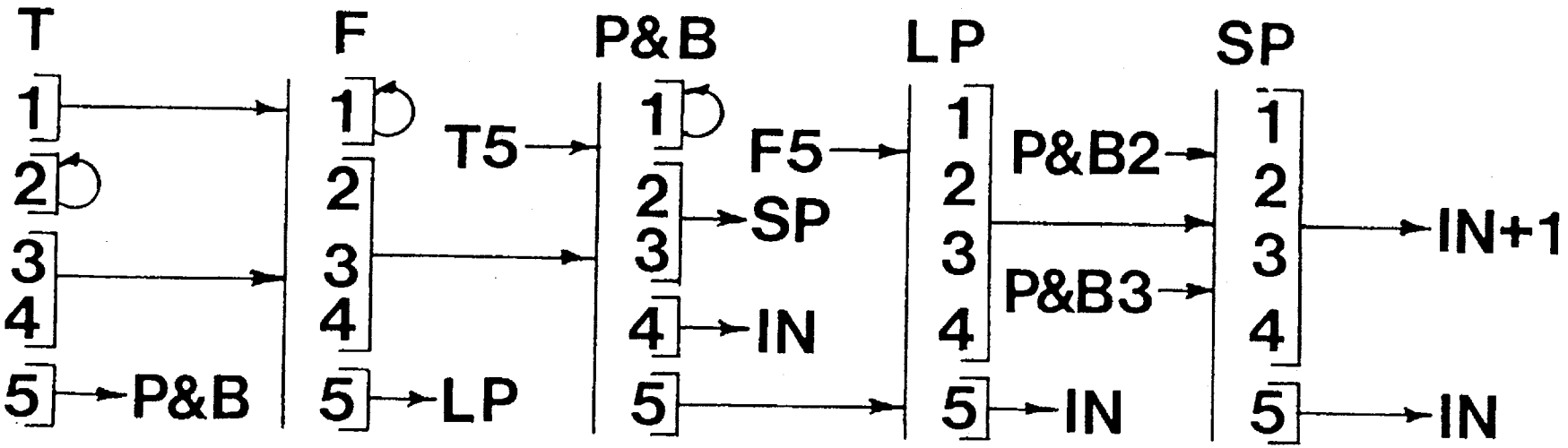
Figure 11:
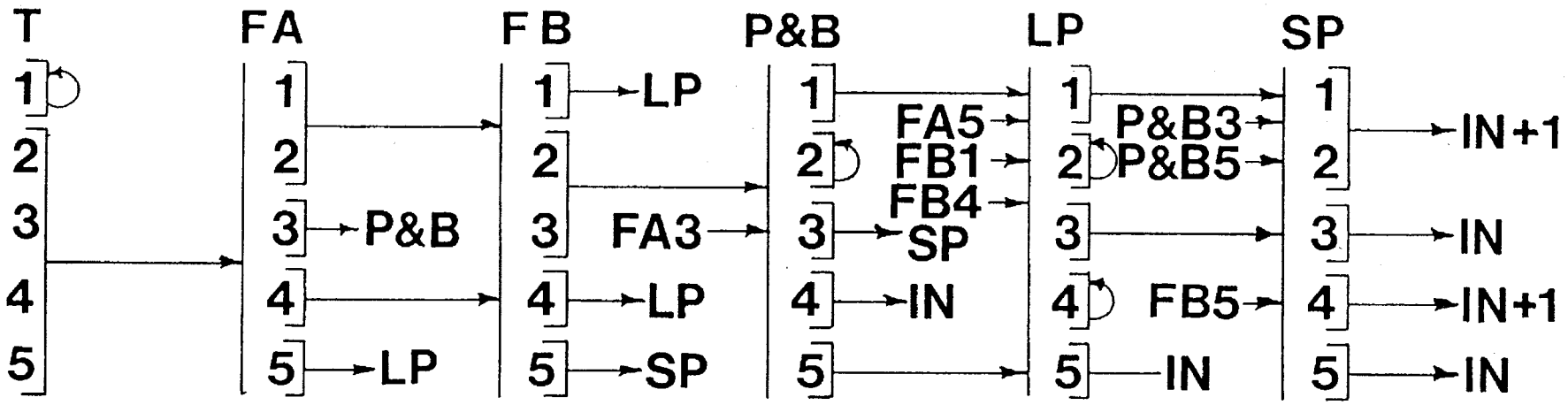

FIGS. 9 to 11 are schematic diagrams showing possible sequences of strokes for a Par 3, Par 4 and Par 5 golf holes respectively.

DESCRIPTION OF THE INVENTION

Figure 1:
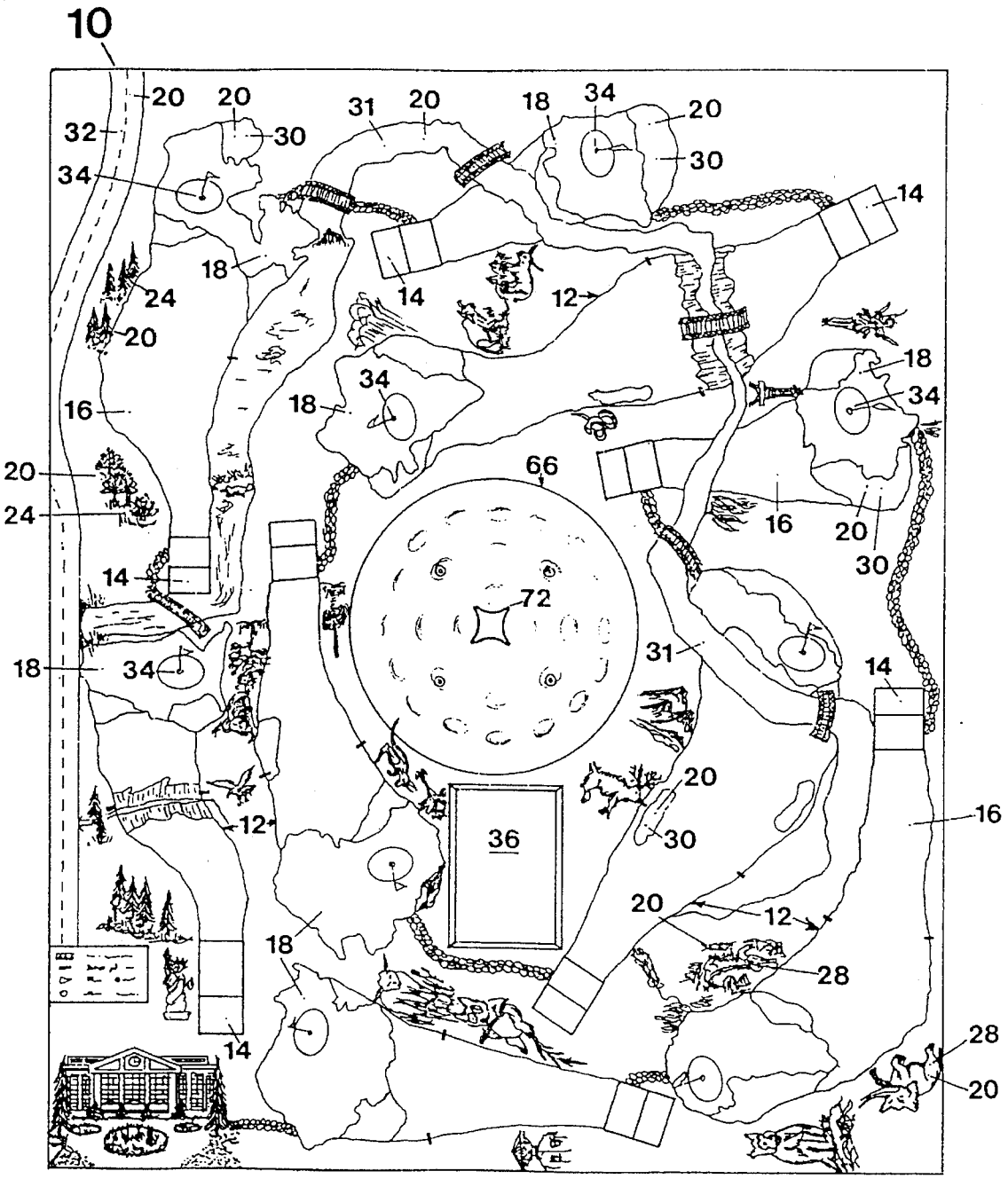
FIG. 1 is a plan view of a game board of the golf board game in accordance with the present invention with place markers removed for the sake of clarity.

In FIG. 1 there is shown a game board 10 of the golf board game of the present invention. The game board 10 conveniently has marked on it a plurality of golf holes 12, such as, for example eighteen golf holes 12. The golf holes 12 are preferably disposed on the game board 10 so that a beginning of one of the golf holes 12 is adjacent an end of a preceding one of the golf holes 12. The golf holes 12 thus wind in a sinuous manner around the board 10. Each of the golf holes 12 comprises a tee area 14, a fairway area 16 and a golf green area 18. The tee area 14 is located at the beginning end of one of the golf holes 12. The fairway area 16 is located adjacent the tee area 14 and extends generally away from the tee area 14. The fairway area 16 connects the tee area 14 to the golf green area 18.

Each of the golf holes 12 may have associated with them areas designated as obstruction areas 20, such as may be found on conventional golf holes. For example, as shown in exemplary golf hole 12 of FIG. 2, the obstruction areas 20 may comprise or denote trees and shrubs 24, canyon 26, wildlife 28 bunker areas 30, creeks 31 and the like. As shown the bunker areas 30 may be associated with the golf green areas 18 or may be located on the fairway areas 16. The first golf hole 12 of FIG. 1 also comprises an obstruction area 20 denoted as a road 32. Referring to both FIGS. 1 and 2, the golf green areas 18 each comprise a golf hole cup 34 denoted by a flag stick or pin.

The board 10 has an area 36 marked out for the placement of gamble cards (to be described hereinafter). It is envisaged that the tee area 14 could be configured to represent the national flag of a golfing nation, such as, for example, the Indian flag for the golf hole 12 of FIG. 2. Similarly, it is envisaged that the golf green area 18 of the golf hole 12 could be formed in the geographical shapes of the country corresponding to the flag representing the corresponding tee area 14. Still further, it is envisaged that the wildlife obstruction area 28 may correspond with wildlife associated with the country whose flag is represented at the tee area 14.

Each of the golf holes 12 also has associated with it a plurality of place markers or zones. There are preferably place markers or zones located on or about each of the fairway areas 16 and each of the golf green areas 18. In the exemplary golf hole 12 of FIG. 2, which is par 5, there are place markers T1 to T5 located at different positions on or about the fairway area 16. The place markers T1 to T5 may be conveniently coloured. The place markers T1 to T5 each correspond to the position of a golf ball on the golf hole 12 as the result of a tee stroke. For example, the place marker T1 is located in the canyon 26 which extends across the entire width of the fairway 16. This corresponds to a very poor tee stroke. The place marker T2 is located in the trees and shrubs 24 off the fairway 16 to the right. This corresponds to a sliced tee stroke to the right of the fairway 16.

The place marker T3 is located slightly beyond the canyon 26 on the fairway 16 adjacent the left side of the fairway 16. The place marker T3 corresponds to a pulled tee stroke.

The place marker T4 is located further beyond the canyon 26 than the place marker T3 and is located slightly to the right of the centre of the Fairway 16. The place marker T4 corresponds to a well struck tee stroke.

The place marker T5 is located even further down the fairway 16 than the place marker T4 and corresponds to a very well struck tee stroke.

Similarly, the golf green area 18 has five place markers FA1 to FA5 located on or about the fairway 16 or the golf green area 18. The place markers FA1 to FA5 may also conveniently be coloured. The place markers FA1 to FA5 correspond to the location of the golf ball as the result of a first fairway stroke.

For example, the place marker FA1 is located off the fairway 16 and adjacent the creek 31. This corresponds to a sliced first fairway stroke.

The place marker FA2 is located off the fairway 16 adjacent the wildlife 28. This corresponds to a hooked first fairway stroke. The place marker FA3 is located on the right hand side of the fairway 16 in front of the golf green 18. The place marker FA3 corresponds to a good first fairway stroke.

The place marker FA4 is located behind the place marker

FA3 but more to the centre of the fairway 16. This corresponds to a nicely struck first fairway stroke. The place marker FA5 is located at the front centre of the golf green 18. This corresponds to a well struck first fairway stroke.

For golf holes 12 with greater than a par 4 rating there are place markers FB1 to FB5 which have black dots in them to signify that they are reached by a second fairway shot. For example, the place marker FB1 is located just behind the place marker FA5 on the golf green 18 and corresponds to a poorly struck second fairway stroke.

The place marker FB2 is located in a left hand bunker 30 on the fairway 16. This corresponds to the case where wind carries the golf ball into the bunker 30. The place marker FB3 is located in a right hand bunker 30. This corresponds to the case of a mishit second fairway stroke. The place marker FB4 is located to the rear of the golf green 18. This corresponds to a good second fairway stroke.

The place marker FB5 is located adjacent the cup 34. This corresponds to a very well struck second fairway stroke. Also, the golf green area 18 has five place markers PB1 to PB3 and PB5 located on the golf green area 18 which may be also conveniently coloured. The place markers PB1 to PB5 correspond to the location of the golf ball as the result of a pitching and bunker stroke. For example, the place marker PB1 is located off and at the rear of the golf green 18 and corresponds to the golf ball skidding off the rear of the golf green 18.

The place marker PB2 is located to the rear and right of the golf green 18. This corresponds to a mishit pitching and bunker stroke.

The place marker PB3 is located adjacent the cup 34. This corresponds to a very well struck pitching and bunker stroke.

The place marker PB5 is located at the very rear edge of the golf green 18. This corresponds to an overstruck pitching and bunker stroke.

Figure 2:
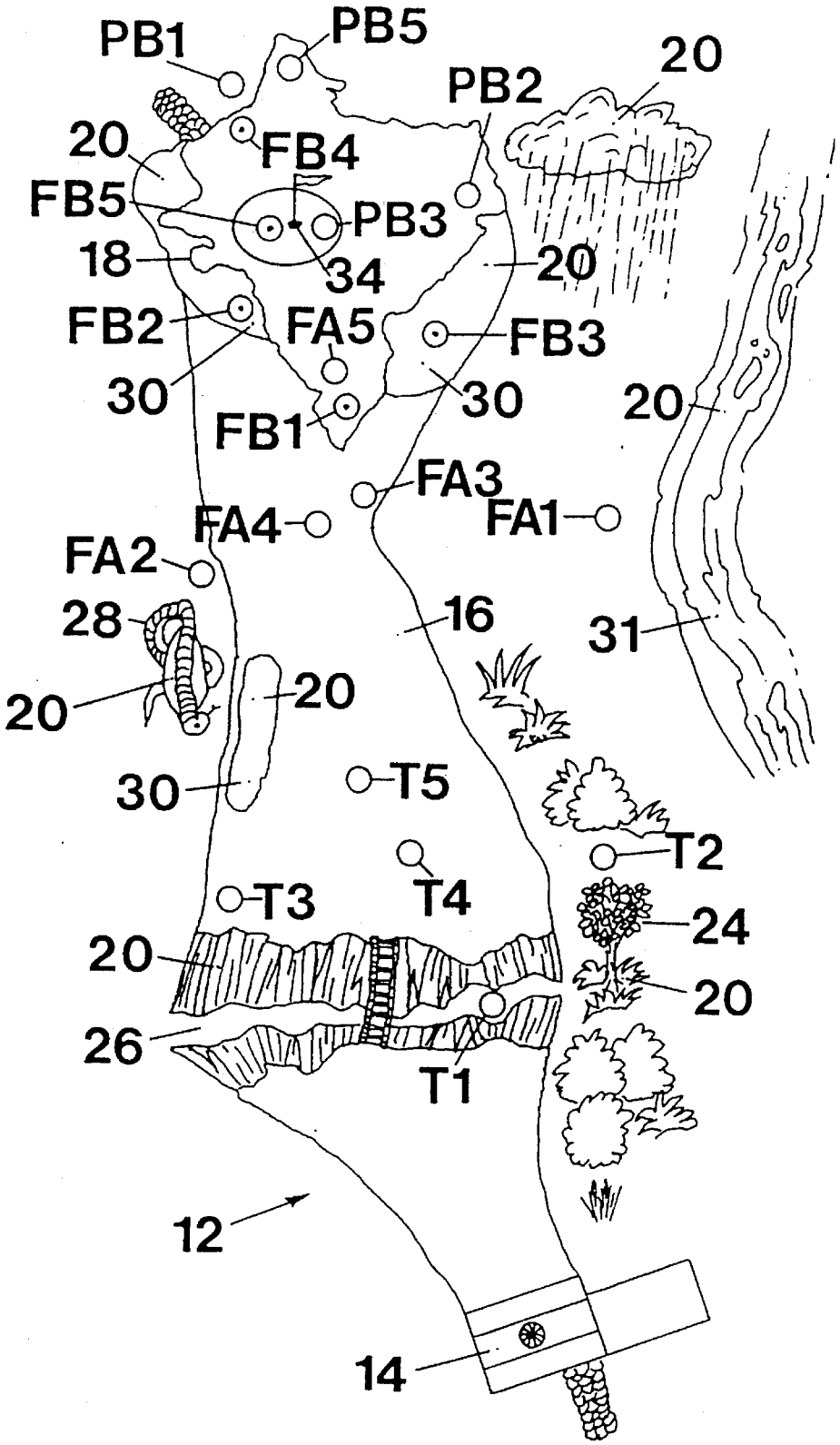
FIG. 2 is an enlarged plan view of a fourth golf hole of the game board of FIG. 1.

The place marker PB4 is not shown on the exemplary golf hole 12 of FIG. 2 since this corresponds to the golf ball going into the cup 34.

Figure 3:
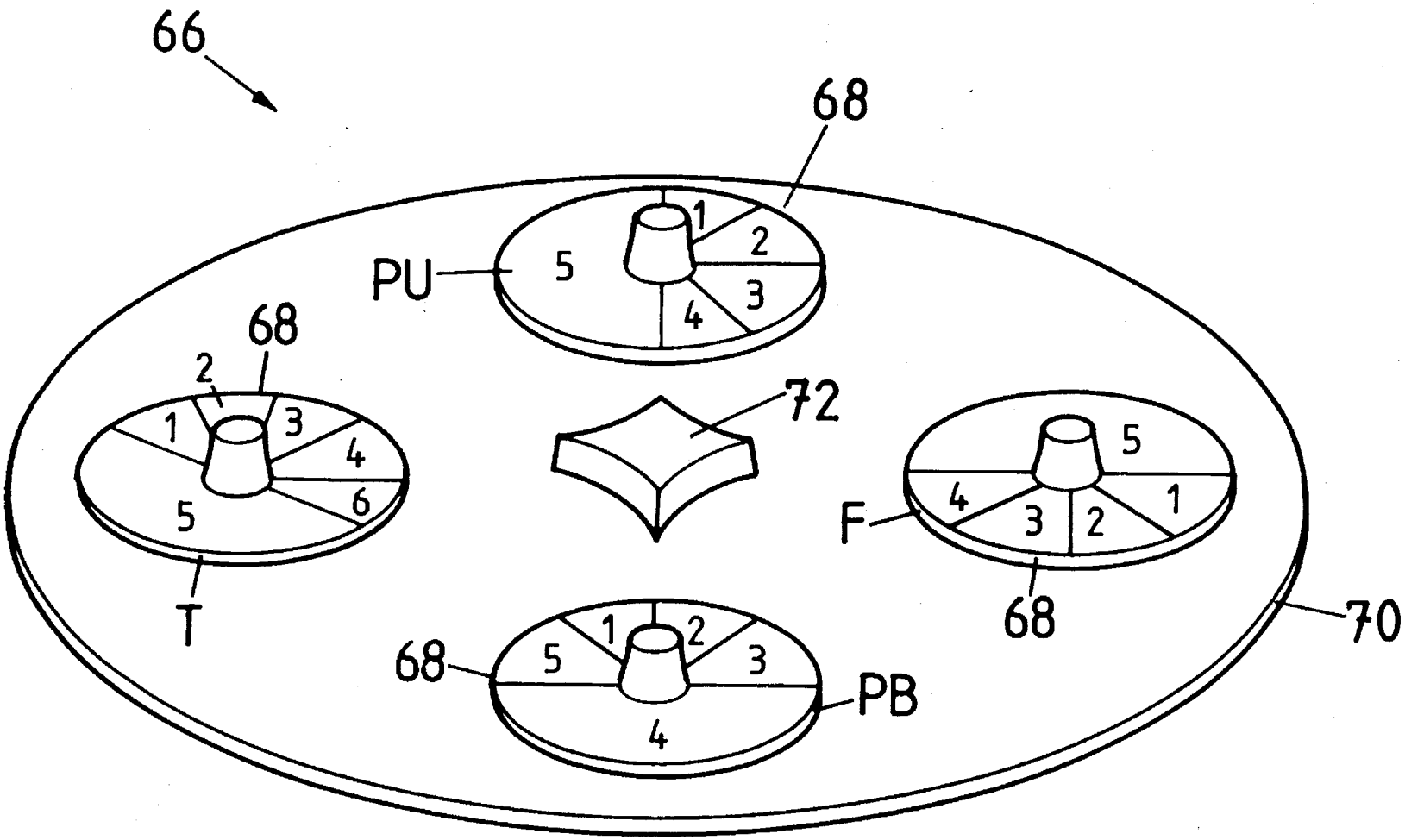
FIG.3 is a plan view of a bank of devices for fortuitously determining the result of a stroke.

Shown in FIG. 3 is bank of devices 66 for determining the result of a stroke.

Conveniently, the bank of devices 66 comprises five discs 68 each of which may be spun upon a block 70. The block 70 is preferably mounted on the board 10. The discs 68 are labelled "T" for a tee stroke, "F" for a first or second fairway stroke, "P&B" for a pitching and bunker stroke and "PU" for a long or short putt stroke. Each of the discs 68 is conveniently marked off into sectors which may be numbered from 1 to 5 or 1 to 6 as shown. The sectors are conveniently coloured to correspond with a respective one of the place markers T1 to T5, FA1 to FA5, FB1 to FB5 and PB1 to PB3 and PB5.

The block 70 comprises a star pointer 72. The pointer 72 is disposed on the block 70 so that the points of the star pointer 72 are able to point to one of the sectors of each one of the discs 68.

Spinning of each of the discs 68 causes the pointer 72 to point at one of the sectors, thus fortuitously determining the result of a particular type of stroke.

Each of the sectors of the discs 68 is determined by the included angle of each sector.

The size of the sectors, determined by the included angles of the discs T, F, P&B, and PU are varied so as to vary the probability of the pointer 72 pointing at one of the sectors. The sectors are of different sizes to reflect the probabilities of achieving a certain result. Typically,

| Type | Sector No. | Included Angle | Probability |
|---|---|---|---|
| TEE | 1 | 45° | 12.5% |
| | 2 | 45° | 12.5% |
| | 3 | 45° | 12.5% |
| | 4 | 45° | 12.5% |
| | 5 | 170° | 47% |
| | 6 | 10° | 43% |
| FIRST OR SECOND FAIRWAY | 1 | 47.5° | 13.25% |
| | 2 | 47.5° | 13.25% |
| | 3 | 47.5° | 13.25% |
| | 4 | 47.5° | 13.25% |
| | 5 | 170° | 47% |
| PITCHING & BUNKER | 1 | 47.5° | 13.25% |
| | 2 | 47.5° | 13.25% |
| | 3 | 47.5° | 13.25% |
| | 4 | 170° | 47% |
| | 5 | 47.5° | 13.25% |
| LONG OR SHORT PUTT | 1 | 47.5° | 13.25% |
| | 2 | 47.5° | 13.25% |

It is to be appreciated that a single sectored disc and pointer could be used in place of the four separate disks 68.

Figure 5:
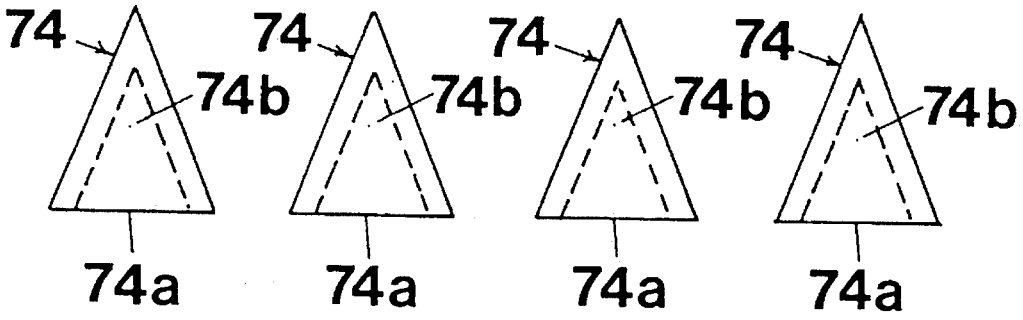
FIG. 5 is an upper perspective view of tokens for use with the golf board game of the present invention.

The golf board game apparatus also comprises a plurality of differently coloured tokens 74 (FIG. 5). Each token 74 has a base 74*a* and a hollow interior 74*b*. In use, the tokens 74 are arranged to be located on the place markers T1 to T5, FA1 to FA5, FB1 to FB5 and PB1 to PB3 and PB5 to represent the location of the golf ball. The tokens 74 may be stacked one on top of another in the event that one or more tokens 74 are located on the same place marker. The golf board game apparatus also conveniently comprises a plurality of hole cards 7 (FIG. 6). The hole cards 76 may include one card for each of the discs T,F, P&B and two cards for the disc PU, one for long putt plays and one for short putt plays per golf hole 12. For example, the hole cards 76 for the exemplary golf hole 12 of FIG. 2 may be as follows:

INDIA 475 m Par 5

TEE

CARD 1

1. Too worried about the hazard ahead, you decelerate during your down swing and the ball lands in the canyon. Add 2 shots including a penalty shot for "out of bounds" and respin, except number 1. Always take a low, slow backswing then concentrate on swinging through the ball.

2. Negative thoughts cause you to slice the ball into the right hand rough, over the canyon. When driving off the tee, try to aim for a target in the distance. Concentrate on making a good shot, not on the trouble that lies ahead. First Fairway Card next.

3. Swinging the club back too straight behind the ball causes you to pull your drive over the canyon to the left side of the fairway. Next shot first Fairway Card.

4. Nice slow swing results in an accurate drive 220 m to the right-hand side of the fairway. Play First Fairway Card next turn.

5. A positive, full flowing swing produces a massive drive to the centre of the fairway 250 meters. Rhythm and timing with good body rotation gives length without strength. First Fairway Card next shot.

FIRST FAIRWAY

CARD 2(*a*)

1. Coins are jingled* by a fellow player as you are about to hit. The distraction causes you to slice your fairway wood to the right and near the creek. Next time, stop your swing if your concentration is disturbed. Next play Second Fairway Card.

2. A hooked fairway wood rolls to the left hand rough and into a cobra's hole. Under the "Local Rules" you may play another ball within two club lengths of this hole, without penalty. Use your legs more during the next swing to help prevent a hooked shot. Play Second Fairway Card next.

3. Swinging smoothly you play a nice wood shot to the right-hand fairway. Rhythm, timing and full rotation of the body having combined to give a long, well-flighted shot. Pitching and Bunker next spin.

4. You make a fair swing and the ball flies straight down the fairway centre. Nice shot. Play Second Fairway Card next.

5. You do everything right during the swing and the result is a mighty fairway wood to the front centre of the green. Play a long putt next.

6. It is bad etiquette to jingle coins, move, or distract player in any way while they are playing their shots.

SECOND FAIRWAY

CARD 2(*b*)

1. An insufficient hip and shoulder turn on the back swing causes a lack of power and leaves the ball short at the front of the putting green. Play your long putt next.

2. You underestimate the strength of the wind and the ball drifts left into the bunker. Sometimes when the wind is gusty it is not easy to allow for. Remember, scores will always be higher in the wind because the course is more difficult then. Pitching and Bunker Card next turn.

3. You sway your body during the swing, and the ball flies into the right hand bunker. If you lose your balance during the downswing you probably have swung too hard at the ball. Spin your Pitching and Bunker shot - next.

4. A nicely struck iron shot finishes at the rear of the green. Play your long putt next.

5. Well done! Correct club selection and a good swing lands the ball on the green next to the flag stick. Have a short putt next.

PITCHING AND BUNKER

CARD 3

1. Wet send after the monsoon rain makes the ball skid out of the bunker and onto the back edge of the green. Next time use your pitching wedge, not the sand wedge, if the bunker is wet. Have a long putt now.

2. What a terrible swing—you lift your head and shoulders up as you hit your shot and half top the ball. It hits the lip of the bunker and rolls back in. Count 1 shot and respin, except number 2.

3. An excellent explosion shot lands the ball 3 meters past the hole with tremendous backspin, it jumps backwards and finishes beside the hole. Fantastic! Play your short putt next.

4. You visualise the ball going into the hole and play just the shot you want. It's in. Beauty!

5. You look up too quickly and skull your shot over the green. Luckily it hits the clubhouse wall and bounces back onto the edge of the green. It's a long putt next.

LONG PUTTING

CARD 4

1. Good putt but the ball runs around the lip of the cup and does not drop in. Concentrate on your short putt next, and try to forget about the near miss.

2. Your long stroke with the putter rolls the ball well past the hole. More practice at putting will help you get the "feel" for distance. Have another long putt.

3. Nicely putted and the ball pulls up close to the pin. Keep the smooth back-and-through action for all your short putts.

4. The greens are heavy after the monsoon rains causing your putt to stop well short. It's still a long putt. Respin except number 4. When the putting surface is wet, make a longer backswing to allow for the slower pace of the green.

5. You imagine the ball rolling into the hole and promptly putt it in. It's amazing how a positive mental attitude will help lead to a good shot.

SHORT PUTTING

CARD 5

1. Your attempt to putt the ball into the hole is unsuccessful, and the ball stops on the edge of the hole. You tap the next one in. Score 2.

2. A player accidentally drops his putter during your stoke and it distracts you. You pull your putt to the left of the hole. The next putt is better, so you are in for 2.

3. The ball is hit too hard but luckily it hits the back of the hole, jumps up and drops in.

4. You block your putt and push the ball right of the hole, then you tap in to score 2. Keep your wrists firm during any putt by making the stroke with the arms and shoulders.

5. A stable body and a well-stroked putt rolls the ball into the hole. It is important not to move your legs during a putt. Some good players lock their knees inwards to prevent any lower body movement during the putting stroke.

As noted hereinabove, the exemplary golf hole 12 of FIG. 2 is a Par 5. The possible sequences of strokes are shown in a schematic flow chart in FIG. 11. As shown, a First Fairway stroke (FA) may only be played if the golf ball is located on one of the place markers T2 to T5. Similarly, a Second Fairway stroke (FB) may only be played if the golf ball is located on one of the place markers FA1, FA2 or FA4. If the golf ball is located on FA3, then a pitching and bunker stroke (P&B) is played next. If the golf ball is located on FA5, then a long putt stroke (LP) is played next. The result of the stroke will determine the place marker to which the golf ball travels. The appropriate card will then indicate the type or nature of the stroke to be played next.

For a Par 3 hole, the cards may be as follows:

SPAIN 187M par 3

TEE

CARD 1

1. Anxious about the bunker in front of the green, you make only a ¾ swing. The ball doesn't travel as far as a full swing, and it lands in the green side bunker. Play your Pitching and Bunker Card next.

2. Moving your body downward during your swing causes you to strike under the ball sending it into the bunker. Play your Pitching and Bunker Card next, and in future try to keep you head level throughout your swing.

3. Cutting slightly across the ball with your club causes the ball to fade a little to the right. Luckily it stops on the slope on the right hand side of the green. Play a long putt next.

4. An incorrect club selection and the ball flies into the back bunker. Have a pitching and bunker shot next. It pays to take time over your decisions. Haste makes waste!

5. You spread your weight fairly evenly and slightly on the inside of both feet, and hit a fine two iron into the heart of the green. Long putt next.

6. Your tee shot is pushed to the right, hits the rump of a bull, bounces back onto the green and into the hole for a "hole in one". A difficult shot to repeat. No bull!

PITCHING AND BUNKER

CARD 2

1. You finish watching the Pro Tournament on Television and picture a smooth bunker swing. A nicely played shot within 10 meters of the hole. Play a long putt next.

2. An open club face with an open stance and your weight set on the left side allows you to play a successful shot onto the back of the green. Well done. Have a long putt now.

3. Fear sets in as you play your bunker shot. You take your eyes off the ball and mishit it, but it stays on the green a long putt away. Block out fear by changing your thoughts drawing on previous successful shots.

4. Your ball has finished in a buried lie, so you close your clubface, swing steeply and hit close to the ball. It pops out into the green. Good shot. Take a long putt next.

5. A beautiful slow swing and a long thin cushion of sand, carries the ball onto the green, where it lands like a butterfly with sore feet! Play a short putt next.

LONG PUTTING

CARD 3

1. Feeling the pressure of your shot, your nerves cause your muscles to tighten and you "yip" your putt short of the hole. Now have a short putt, but this time grip the putter lightly and in future consider reversing your hand position called the reverse-handed grip.

2. A strong gust of wind blows up as you hit your putt, which leaves the ball still a short putt distance past the hole.

3. Allowing for too much break, you miss a long way left. Sometimes it is difficult to work out the amount of distance you need to allow to aim to one side of the hole. Take a long putt again.

4. Your over cautious putt fails to make the distance. Always make a stroke through towards the hole. It is better if the ball rolls past the hole. You can then read the break of the putt you have back to the hole. Short putt next.

5. Superb putt! By watching the putter head striking the back of the ball, you make a perfect pendulum-type stoke and the ball rolls on beautifully into the hole. Yippee!

SHORT PUTTING

CARD 4

1. Bad luck! The ball hits another player's marker and misses. You putt in for 2. Always make sure any ball markers on the green are not in your ball's path to the hole.

2. The grain on the green causes the ball to jump off line to the left of the hole. You stroke it in for 2 putts. Grainy greens are difficult to putt with success.

3. Decelerating on the downswing leaves the ball short. Deceleration usually results form a backswing that is too long. Practice a shorter backswing with greater acceleration through the ball. You tap the next putt in. Score 2.

4. Just unlucky—the ball lips out of the hole. You putt in for 2. Golf involves a lot of luck. Keep positive and the odds will start to go your way.

5. Keeping a steady body enables you to putt the ball straight in. Well done, remember this for all your future putts.

The possible sequences of strokes for this exemplary par 3 hole are shown in a schematic flow chart in FIG. 9. As shown, a pitching and bunker stroke (P&B) is played only if the golf ball is located on one of the place markers T1, T2 or T4. Similarly, a long putt (LP) is played next if the golf ball is located on one of T3, T5 or PB1 to PB4.

For a Par 4 hole, the cards may be as follows:

U S A

300m Par 4

TEE

CARD 1

1. You have swung too quickly resulting in a hooked shot into the pine trees in the left hand rough. Keep your swing rhythmic. Fairway Card next.

2. Conscious of the crowd around the first tee, you nervously top your drive and it rolls 3 meters. Respin from the tee area, except number 2. Count 1 shot and keep calm.

3. Your drive is pulled to the left side of the fairway. For straighter shots swing more around your body on the backswing and finish with your hands high on the follow through. Fairway Card next turn.

4. Pushed drive towards the right hand rough. Luckily, your ball hits a bald eagle (outside agency) in flight and is deflected back onto the fairway. No penalty. What luck! Fairway Card next.

5. Well planned one wood shot. Great drive 230 m down the centre of the fairway. It pays to keep your swing extra slow during the early holes of the game. Play your Pitching and Bunker Card next.

FAIRWAY

CARD 2

1. A flat swing with an iron results in a hooked shot onto the road. Go back to where the shot was played. Respin except No. 1. Add 2 penalty shots and 1 shot for the respin.

2. Poor club selection leaves you short of the green in the left hand bunker. Next time, work out your distances to the green before selecting your club. Play your Pitching and Bunker Card next.

3. By swaying on the back swing, you hit a fat shot short of the green on the centre fairway. Pitching and Bunker card next.

4. Uncertain about your shot, you hit a thin iron which flies the ball over the green and into the river. Add a penalty shot and drop the ball at the nearest point of relief near the river, no closer to the hole. Score 2. Play a pitch next.

5. By swinging with rhythm instead of striving for power, you hit a sweet shot to the heart of the green. Use the long putting card next.

PITCHING AND BUNKER

CARD 3

1. Your club head catches the ground and it miss-hits the ball, which rolls into the bunker on the right hand side at the front of the green. Respin except Number 1 and add 1 shot.

2. The ball is played too far back in your stance, but it has turned out well and runs to within 4 meters of the hole. Play a short putt next.

3. Very good short shot. The ball lands on the green and bounces up alongside the hole. Play your short putt next.

4. Beautifully played. The shot is so perfect that the ball runs straight into the hole. Well done. Rhythm helps when playing any shot.

5. Undecided on how to play your chip, you hit the ground behind the ball, which leaves it 5 meters from the hole. Next time try to have only one mental image of the shot before you go to hit the ball. Play a long putt next.

LONG PUTTING

CARD 4

1. You walk up to the ball and play the putt without allowing for the break of the green. The ball misses below the hole. Next time take more care with your preparation. Short putt next.

2. Your tight grip on the putter results in a strong putt, which over-runs the hole. When putting grip the club lightly. Take a short putt next.

3. Approaching the putt from the side, you aimed too far left and hit the ball to the left side of the hole. For better results line up your putts from behind the ball. Play your short putt next.

4. You look up to see the ball roll towards the hole, which causes the putter to lift up, and the ball stops short of the hole. In future watch your putter hit the back of the ball and listen for the sound of the ball dropping into the hole. Next shot is a short putt.

5. Putting like a Pro! You take your time, assess the break on the green and confidently stroke the ball into the hole.

SHORT PUTTING

CARD 5

1. You putt too confidently and the ball overruns the hole. Fortunately, the next putt goes in. Count 2.

2. A strong clasp on the putter with the left hand results in a push to the right of the hole. Gripping softly on the next putt you stroke the ball in. Count 2.

3. A good stroke with your first putt but it lips out. You were unlucky but you tap in the next putt for 2. Don't worry Pro's often have the same problem.

4. You pull your hands to the left as you hit your putt and the ball misses the hole to the left. You concentrate on pushing the putter straight through and the ball dives in. Keep this thought in mind for future putts. Score 2.

5. Picturing the ball rolling down a railway line and into the hole, you make a fine putt which sends the ball into the hole. Make this a blueprint for your putting.

The possible sequences of strokes for this exemplary par 4 hole are shown in a schematic flow chart in FIG. 10. As shown, a Fairway stroke (F) may only be played if the golf ball is located on one of the place markers T1, T3 or T4. Similarly, if the golf ball is located on one of T1, F2, F3 or F4 then a pitching and bunker stroke (P&B) is played next. Also, a short putt stroke (SP) is only played if the result of the previous stroke was one of PB2, PB3 or LP1 to LP4.

As is apparent especially from FIG. 2, there are no place markers indication strokes which have the results LP1 to LP5 or SP1 to SP5. These results correspond to the golf ball being relatively close to the cup ie. within putting distance.

As is apparent from FIG. 9, the tee card for a Par 3 hole has six possible results for a tee stroke. The result numbered six corresponds to a hole-in-one and to the sector marked 6 on the disc T. For other than Par 3 holes, there is no possibility of achieving a hole-on-one result so this sector is ignored when playing other holes.

The numbers appearing on the hole cards 76 relate to the numbers appearing in the corresponding discs T,F P&B and PU. The golf board game also comprises a plurality of score cards 75 typically shown in FIG. 4. It is intended that the score cards 75 be printed up in to appear as conventional score cards.

The golf board game also comprises a plurality of gamble cards 78 (FIG. 7) to fortuitously change a player's or an opponent's score. The gamble cards 78 may also fortuitously gain or lose money for the player or his opponents. Typically, the gamble cards 78 may be as follows:

GOLF GAMBLE CARD

Jingling your keys upsets your opponent's concentration. You are fined $100 payable to each player, under the bonus golf etiquette. Spin again except your previous number.

GOLF GAMBLE CARD

Your caddy shelters you from the whether whilst playing your shot. Receive a penalty of 2 shots and spin again excluding the number you previously spun.

GOLF GAMBLE CARD

Other players talk during your shot upsetting your concentration. Under the local bonus golf rules you fine them $500 each payable to you. Spin again except the number just played.

GOLF GAMBLE CARD

Your fellow players have each played the wrong ball. They must add 2 shots penalty to their score and replay (Respin) their shot.

GOLF GAMBLE CARD

Your fellow players are driving recklessly in their golf carts, onto tees and greens. They must each pay you $1000 under the bonus etiquette rules. Respin.

GOLF GAMBLE CARD

You receive the "Hardest Tryer" award—collect $1,000 from the bank. Respin any number other than your last spin.

GOLF GAMBLE CARD

How silly of you. You lose your temper and slam your club into the ground. Unfortunately an official sees your action and fines you $1000. Spin again any number except the number you just spun.

GOLF GAMBLE CARD

Other players talk during your shot upsetting your concentration. Under the local bonus golf rules you fine them $1000 each payable to you. Spin again except the number just played.

GOLF GAMBLE CARD

You played out of turn. The course rules for this tournament say that you must pay a fine of $1000 to each player. Spin again except your previous number.

GOLF GAMBLE CARD

Because you are day dreaming you touch the ball with your practice stroke. Score 1 shot and spin again except the number you previously played.

GOLF GAMBLE CARD

Your partner informs you that you have 15 clubs in you bag but you are only allowed to have 14 clubs. You could have been disqualified from the event, however, the official does not know the rules and you are let off with a 2 shot penalty and $1000 fine. Spin again any number other than your last spin.

GOLF GAMBLE CARD

Standing too close to your fellow player disturbs his swing. Pay $1000 to each of your fellow players, under the bonus golf etiquette rules. Spin again any number other than your previous spin.

GOLF GAMBLE CARD

Fellow players stand directly behind your ball while you play your shot. They are each fined $1000 payable to you under the bonus etiquette rules. Spin again.

GOLF GAMBLE CARD

Jingling your keys upsets your opponent's concentration. You are fined $1000 payable to each player, under the bonus golf etiquette rules. Spin again except your previous number.

GOLF GAMBLE CARD

It is noted that you have played out of turn. Pay each player $500 under the bonus etiquette rules. Spin Again.

GOLF GAMBLE CARD

What great luck you find $3000 on the course. Add this to your prizemoney and respin.

GOLF GAMBLE CARD

You accidentally drop the flagstick on the green causing some damage. Under the game etiquette rules you must pay the other players $1000. Respin.

GOLF GAMBLE CARD

You have scuffed the green badly by not lifting your feet on a particular hole. Pay a $1000 fine to your fellow players. In future lift your feet carefully on greens. Respin.

GOLF GAMBLE CARD

Anger gets the better of you and you toss your ball into the air. It lands heavily on the head of one of your fellow players, he is rendered unconscious and drops to the ground. Displays of anger are not tolerated under bonus etiquette rules. Pay $1000 to each player and spin again, not your last number.

GOLF GAMBLE CARD

Whoopie—you win $5000 in the lucky draw at the clubhouse! Add this to your prizemoney and spin again.

GOLF GAMBLE CARD

Carelessly you play the wrong ball incurring a 2 shot penalty. Spin again, better luck this time.

GOLF GAMBLE CARD

You have upset your sponsor by your poor conduct. He withdraws his endorsement. Pay the bank $2000 immediately. Spin again except the number you just played.

GOLF GAMBLE CARD

You are selected as the perfect model to wear the latest fashion clothing. A sponsor pays you $5000 and will send you a free wardrobe of clothes after the game. Spin again except the number last played.

GOLF GAMBLE CARD

Officials have just informed you that your late arrival at the course will cost you 2 shots penalty and a $1000 fine. Respin any number other than your last spin.

GOLF GAMBLE CARD

Not thinking about the rules you hit a practice ball from the practice fairway between shots. Receive a penalty of 1 shot and spin gain except the number you have just spun.

GOLF GAMBLE CARD

Your fellow players have not been repairing pug marks. They must each pay you $1000 under the etiquette rules for the game. Now spin again.

GOLF GAMBLE CARD

Not sighting your ball properly you accidentally knock it with your club. Count 1 shot penalty and respin except your last number.

GOLF GAMBLE CARD

Dawdling on the course doesn't pay—you receive a 2 shot penalty. Make sure you keep us with the players in front of you, never be more than one fairway behind them. Respin any number other than your last spin.

GOLF GAMBLE CARD

You group of players has lost a ball. You wave the next group of players through immediately. Your good course conduct is noticed and rewarded with $1000. Add this to your prizemoney and respin any number other than your previous spin.

GOLF GAMBLE CARD

Oh my goodness! You are informed that a spectator has been accidentally injured by one of your previous shots. You pay $1000 to cover medical expenses. Spin again except the number you have just spun.

GOLF GAMBLE CARD

Very carelessly you hit the wrong numbered golf ball. Score two penalty shots and respin except the number you have just spun.

GOLF GAMBLE CARD

You are late paying your membership fees. Pay $2000 out of your prizemoney. Respin.

GOLF GAMBLE CARD

Jolly bad luck! Your ball hits your caddy and you are penalised 2 shots. Have another spin. Good luck this time!

GOLF GAMBLE CARD

Your practice swings damage the course. Pay the bank $1000 and respin.

GOLF GAMBLE CARD

Under the bonus golf local rules the officials have fined your fellow players $1000 each for obscene gestures. The money comes to you, add it to your prizemoney. Spin again except your previous number.

GOLF GAMBLE CARD

You dangerously walk ahead of your fellow players as they are about to play, pay $1000 to each player and don't do it again! Respin.

GOLF GAMBLE CARD

Ace card!

Deduct 2 shots on any nominated hole. Respin!

GOLF GAMBLE CARD

Careful replacement of your divots attracts a bonus by officials of $1000. Spin again.

GOLF GAMBLE CARD

Naughty, naughty! You are caught kicking your ball during play. Your penalty is 1 shot and a $1000 fine paid to each player. Spin again except this number.

GOLF GAMBLE CARD

You are on the lucky spot for a special event conducted for the tournament. Add $5000 to your prizemoney, and respin.

GOLF GAMBLE CARD

Careful restoration of divots, ball marks and damage by spikes is rewarded with $5000 cash by the golf course committee. Spin again any number except your previous spin.

GOLF GAMBLE CARD

Your opponents are caught cheating under the game etiquette rules. They must each pay you $1000. Cheats never prosper! Respin any number other than your last spin.

GOLF GAMBLE CARD

How incredibly lucky—a sponsor likes the way you play and gives you $10000 for endorsing the hats he manufactures. Add this to your prizemoney then spin again except for the number previously spun!

GOLF GAMBLE CARD

Oops! You have slipped on a banana skin and your club connects with the ball. The ball hardly moves, score 1 shot and spin again except this number.

GOLF GAMBLE CARD

Good news, you accidentally overpaid your membership fees. Receive $2000. Spin again.

GOLF GAMBLE CARD

Sorry, please spin again, any number, except your previous spin.

GOLF GAMBLE CARD

Fellow players are swearing on the course which attracts a fine of $1000 payable to you. Spin again, any number, except your previous spin.

GOLF GAMBLE CARD

How lucky can you be! You have just won the tournament lucky draw prize money. Spin again any number except the number you have just spun. Add you $5000 prize to your prizemoney.

GOLF GAMBLE CARD

A sponsor has observed your brilliant putting on tournaments and offers you $20000 cash to use their brand putter during future tournaments. Add this to your prizemoney. Respin any number except your previous spin.

GOLF GAMBLE CARD

You are very, very careless! You have played the wrong ball! Take a 2 shot penalty and spin again.

GOLF GAMBLE CARD

You receive the "shot of the tournament" award. Add $5000 to your prizemoney. Spin again any number except the number that you have just spun.

GOLF GAMBLE CARD

The wet grass causes you to slip midway through your stroke and you miss the ball. Score 1 shot and spin again.

GOLF GAMBLE CARD

Take the number 5 spin result for this shot.

In use, one or more players may play the golf board game of the present invention, for example, there could be up to 8 players.

The players determine their handicap by any convenient means for the purposes of scoring.

The players then spin the discs T,F, P&B and PU and move their tokens 74 about the golf holes 12 in a manner dependant on the colour and/or number of the sector of the disc 68 which rests against a corresponding point of the star pointer 72. The colour and/or number of the sector to which the pointer 72 points is typically matched to the colour and/or number of the place marker on or about the golf hole 12. The token 74 is then moved to the place marker which is of the same colour and/or number as the sector of the disc 68.

For example, if the pointer 72 points to the sector numbered "5" of Disc T, the relevant player moves his/her token 74 to the place marker T5.

The players determine, by any convenient means, who is to start first. Play may then follow in a clockwise order. At the end of play for each golf hole 12, the player with the lowest score, as described hereinafter, commences the play for the following golf hole 12. The remaining players again may play in a clockwise order.

For example, if the par 5 golf hole 12, of FIG. 2, is being played, play would proceed as follows.

The first player spins the disc T and reads the number and/or colour of the sector of the disc T which comes to rest adjacent the pointer 72. The player then reads the tee hole card 76 and takes the action specified on the tee hole card 76 for the particular number to which the pointer 72 is pointing. For example, if the sector marked "5" is indicated, the play of number 5 on the tee hole card 76 is performed by moving his/her token 74 to the relevant place marker, T5 in this example. Further, the tee hole card 76 specifies the type of stroke to be played next, in this case a First Fairway stroke. The player would then spin the disc F and consults the First Fairway hole card 76 for the result of his stroke and the next stroke to be played. For example, if the sector marked "3" is indicated, the player's token 74 is moved to place marker FA3. The First Fairway card 76 then specifies that a pitching and bunker stroke is to be played next. The player then spins the disc P&B, the result of which may be "3". The token is then moved to the place marker PB3. The pitching and bunker card 76 indicates that the golf ball is adjacent the cup 34 and a short putt is to be played next. The disc PU is then spun and the result may be "4". The short putt hole card 76 indicates that the player has two putted the golf ball into the cup 34.

The play continues for the remaining players and for the remaining hole cards 76 for the golf hole 12 in similar manner.

With regard to the long putt hole cards 76, the numbers 1 and 3 result in the playing of a short putt hole card 76, whereas the numbers 2 and 4 results in re-playing of the long putt hole card 76. Also, the number 5 does not require to the playing of a further stroke because the golf ball has been successfully putted into the cup 34. For each spin of the discs T,F P&B and PU the player adds one point to his/her score card 75. Where the spin incurs a penalty the amount of the penalty is also added to the player's score card 75. The aggregate number of spins and penalties for the golf hole 12 represents the player's score for the golf hole 12.

The player(s) who complete a golf hole 12 with the lowest score is considered to have won that golf hole 12. The player(s) who completes the entire course of eighteen golf holes 12 with the lowest aggregate score is considered the winner of the game.

In another version, each player is provided with an initial sum of initial play money (FIG. 8), typically $50,000 from a bank.

In this version, a player may wish to take a gamble by predicting his score before playing the golf hole 12. Any amount of money may be gambled and if the player has correctly predicted his score, then the bank will pay him three times the amount gambled. If the player has not correctly predicted his score, then his money is paid into the bank.

After playing a stroke, a player may accept the result of the stroke or elect to pay the bank $500. This enables the player to take a gamble card 78, disregard the result of his stroke and spin the appropriate discs 68. The result of the gamble card may be to increase or decrease the score of the player and/or his opponents. Further, the result of the gamble card 78 may be to increase or decrease the money held by of the player and/or his opponents.

Play is continued in a similar manner to the version described hereinabove, and the player with the most money at the end is deemed the winner.

By virtue of the present invention people may learn the rules etiquette and terms of golf without having to play many games of golf. Further, a person may receive golf coaching and golf tips without the need and cost of lessons from a professional golfer.

It is envisaged that the golf game board of the present invention could be used to play in accordance with conventional rules for Stableford competition golf, Bogey or Par competition golf, Ambrose competition golf, Four Ball Better Ball competition golf, Four Ball Combined competition golf, Foursomes competition golf, skins golf and the like. It is envisaged that the handicaps may be calculated in any desired manner. For example, the average out of par score maybe taken over say three games and used as the handicap. It is envisaged that the place markers could be replaced by coded areas marked on and about each of the golf holes 12.

It is also envisaged that each of the golf holes 12 could comprise a second tee area (not shown) located nearer to each respective golf green area 18. Such second tee areas correspond to ladies tee-off areas used in conventional golf courses.

It is further envisaged that the game board 10 could be a foldable board of about 500×600 mm or a three dimensional contoured board of similar base area or a magnetic type board of about 300×250 mm, all with container means for the tokens and the deck of cards.

Modifications and variations such as would be apparent to a skilled addressee are deemed within the scope of the present invention.

We claim:

1. A golf board game apparatus a board marked out into a plurality of golf holes; each of the golf holes comprising a tee area, a fairway area, an obstruction area and a green area having a pin; a plurality of distinct place markers at each golf hole comprising a set of place markers representing the results of a tee stroke, and at least one set of place markers representing the result of at least one stroke subsequent to the tee stroke, each golf hole having first card means having an indication of place markers to which a golf ball travels as a result of the tee stroke, and also having an indication of the nature of the next stroke to be played, each golf hole further having at least second card means having an indication of the results of a subsequent stroke including at least two possible results on each second card means and any of an indication of the place marker to which a golf ball travels as a result of a subsequent stroke and an indication of the nature of the next stroke to be played wherein, the card means of each golf hole contains information unique to that golf hole so that conditions of play vary from golf hole to hole; and means for fortuitously determining the result of the tee stroke and all subsequent strokes for each hole by indicating which result of the respective card means is to be referred to.

2. A golf board game apparatus according to claim 1 further comprising at least one par 3 golf hole comprising a set of place markers representing a tee stroke, a set of place markers representing a pitching and bunker stroke and at least one set of place markers at the green area representing putting strokes, and corresponding card means for each of the sets of place markers.

3. A golf board game apparatus according to claim 1 further comprising at least one par 4 golf hole comprising a set of place markers representing a tee stroke, a set of place markers representing a fairway stroke, a set of place markers representing a pitching and bunker stroke, and at least one set of place markers at the green area representing putting strokes, and corresponding card means for each of the sets of place markers.

4. A golf board game apparatus according to claim 1 further comprising at least one par 5 golf hole comprising a set of place markers representing a tee stroke, at least two sets of markers representing fairway strokes, a set of place markers representing a pitching and bunker stroke, and at least one set of place markers at the green area representing putting strokes, and corresponding card means for each of the sets of place markers.

5. A golf board apparatus according to claim 1 wherein each place marker has a visual identifier corresponding to a result of a stroke of a corresponding means for fortuitously determining the result of a stroke.

6. A golf board game apparatus according to claim 1 wherein the card means also contain indications as to any of golf etiquette, golf rules, and golf coaching tips.

7. A golf board apparatus according to claim 1 wherein the means for fortuitously determining the results of the tee and each subsequent stroke comprises at least one rotatable disk adapted to be spun and having a plurality of sectors marked thereon corresponding to a possible result of a stroke, and pointer means operatively connected to the rotatable disk to indicate the result of each spin.

8. A golf board game apparatus to claim 7 wherein the sectors are of different sizes selected to reflect the approximate probabilities of achieving each of the possible results.

9. A golf board game apparatus according to claim 8 wherein each rotatable disk is mounted on the game board.

10. A golf board game apparatus according to claim 1 further comprising a plurality of gamble cards which increase or decrease the score of any of a player and his opponent upon being drawn.

11. A golf board game apparatus according to claim 10 further comprising play money for the players and the gamble cards increase or decrease the amount of money held by any of a player and his opponent upon being drawn.

12. A golf board game apparatus according to claim 1 further comprising a token for each player, the token being moved progressively form the tee area to the pin from marker to marker to indicate the position of the players golf ball on the golf hole.

13. A golf board game apparatus according to claim 12 wherein the tee area of one golf hole is adjacent the golf green area of a previous golf hole so that the plurality of golf holes wind in a sinuous manner around the game board.

* * * * *

UNITED STATES PATENT AND TRADEMARK OFFICE

CERTIFICATE OF CORRECTION

PATENT NO. : 5,470,077

DATED : November 28, 1995

INVENTOR(S) : Wilfred George Brewster

It is certified that error appears in the above-indentified patent and that said Letters Patent is hereby corrected as shown below:

Title page, item [87], "WO90/00443" should be --WO90/04437--.

Column 3, line 67, after "Typically," insert --the sizes of the sectors may be arranged in the following manner:--

Column 4, line 19 (in table), insert

| | | |
|---|---|---|
| --3 | 47.5° | 13.25% |
| 4 | 47.5° | 13.25% |
| 5 | 170° | 47%-- |

Column 5, line 25, "6" should be --*--

Column 10, line 12, "T1" should be --T5--.

UNITED STATES PATENT AND TRADEMARK OFFICE

CERTIFICATE OF CORRECTION

PATENT NO. : 5,470,077

DATED : November 28, 1995

INVENTOR(S) : Wilfred George Brewster

It is certified that error appears in the above-indentified patent and that said Letters Patent is hereby corrected as shown below:

Column 16, Claim 1, line 1, after "apparatus" insert --comprising--

Column 18, Claim 12, line 3, "form" should be --from--

Signed and Sealed this

Fourth Day of June, 1996

Bruce Lehman

*Attest:*

BRUCE LEHMAN

*Attesting Officer*

*Commissioner of Patents and Trademarks*